US005730369A

United States Patent [19]

De Nagel et al.

[11] Patent Number: 5,730,369

[45] Date of Patent: Mar. 24, 1998

[54] FUEL INJECTION

[75] Inventors: Stephen Francis De Nagel, Warren; Arun Sushilkumar Paulr Solomon, Rochester Hills; Edward Daniel Klomp, Clinton Township, all of Mich.

[73] Assignee: General Motors Corporation, Detroit, Mich.

[21] Appl. No.: 233,088

[22] Filed: Apr. 25, 1994

[51] Int. Cl.[6] ..... F02M 67/02

[52] U.S. Cl. ..... 239/585.4

[58] Field of Search ..... 239/585.1–585.5, 239/413, 414, 432, 433, 408–410

[56] References Cited

U.S. PATENT DOCUMENTS

| | | | |
|---|---|---|---|
| 4,266,727 | 5/1981 | Happel et al. | 239/414 X |
| 4,590,911 | 5/1986 | Sciotti et al. . | |
| 4,753,213 | 6/1988 | Schlunke et al. . | |
| 4,776,516 | 10/1988 | Klomp . | |
| 4,794,902 | 1/1989 | McKay . | |
| 4,841,942 | 6/1989 | McKay . | |
| 4,978,074 | 12/1990 | Weinard . | |
| 4,986,247 | 1/1991 | Kushibe et al. | 239/413 X |
| 5,036,824 | 8/1991 | Albertson et al. . | |
| 5,353,991 | 10/1994 | DeNagel et al. | 239/585.3 X |

FOREIGN PATENT DOCUMENTS 18902 of 1910 United Kingdom .

*Primary Examiner*—Kevin Weldon

*Attorney, Agent, or Firm*—Charles K. Veenstra

[57] ABSTRACT

An injector for delivering a charge of fuel and air to an engine includes a central passage extending from an air inlet to a valve seat, a poppet valve secured on a valve stem extending through the central passage and engageable with the valve seat, a poppet valve engageable with a valve seat for controlling flow therethrough, a fuel nozzle opening into the air passage near the valve seat, apparatus for periodically metering fuel through the nozzle into the central passage to create a fuel-air charge in the central passage concentrated near the valve seat, and apparatus for periodically disengaging the poppet valve from the valve seat for delivering the fuel-air charge from the central passage.

2 Claims, 3 Drawing Sheets

FUEL INJECTION

TECHNICAL FIELD

This invention relates to an injector adapted to deliver a charge of fuel and air directly into an engine combustion chamber.

BACKGROUND

U.S. Pat. No. 4,753,213 issued 28 Jun. 1988 in the names of C. K. Schlunke, P. W. Ragg, R. M. Davis and P. C. Lucas, and U.S. Pat. No. 5,036,824 issued 6 Aug. 1991 in the names of W. C. Albertson, G. E. Pospiech and L. H. Weinand show injectors that deliver a fuel-air charge directly into the combustion chamber of a two-stroke cycle engine. Each injector has a valve that meters fuel into the injector where the fuel mixes with air to form a fuel-air charge, and another valve that delivers the fuel-air charge into the engine. Separate solenoids actuate the valves in sequence. Another such injector is shown in copending application Ser. No. 07/841,909 filed 26 Feb. 1992 in the names of S. F. DeNagel, E. D. Klomp and A. M. Pawlak.

SUMMARY OF THE INVENTION

This invention provides an injector intended to minimize retention of metered fuel and thereby minimize carryover of retained fuel from one injection event to the next.

In an injector according to this invention, the fuel is metered into the injector as close as possible to the charge delivery exit to minimize atomization within the injector and keep the fuel concentrated near the charge delivery exit.

The details as well as other features and advantages of several injectors employing this invention are set forth in the remainder of the specification and are shown in the accompanying drawings.

DETAILED DESCRIPTION

Figure 1:
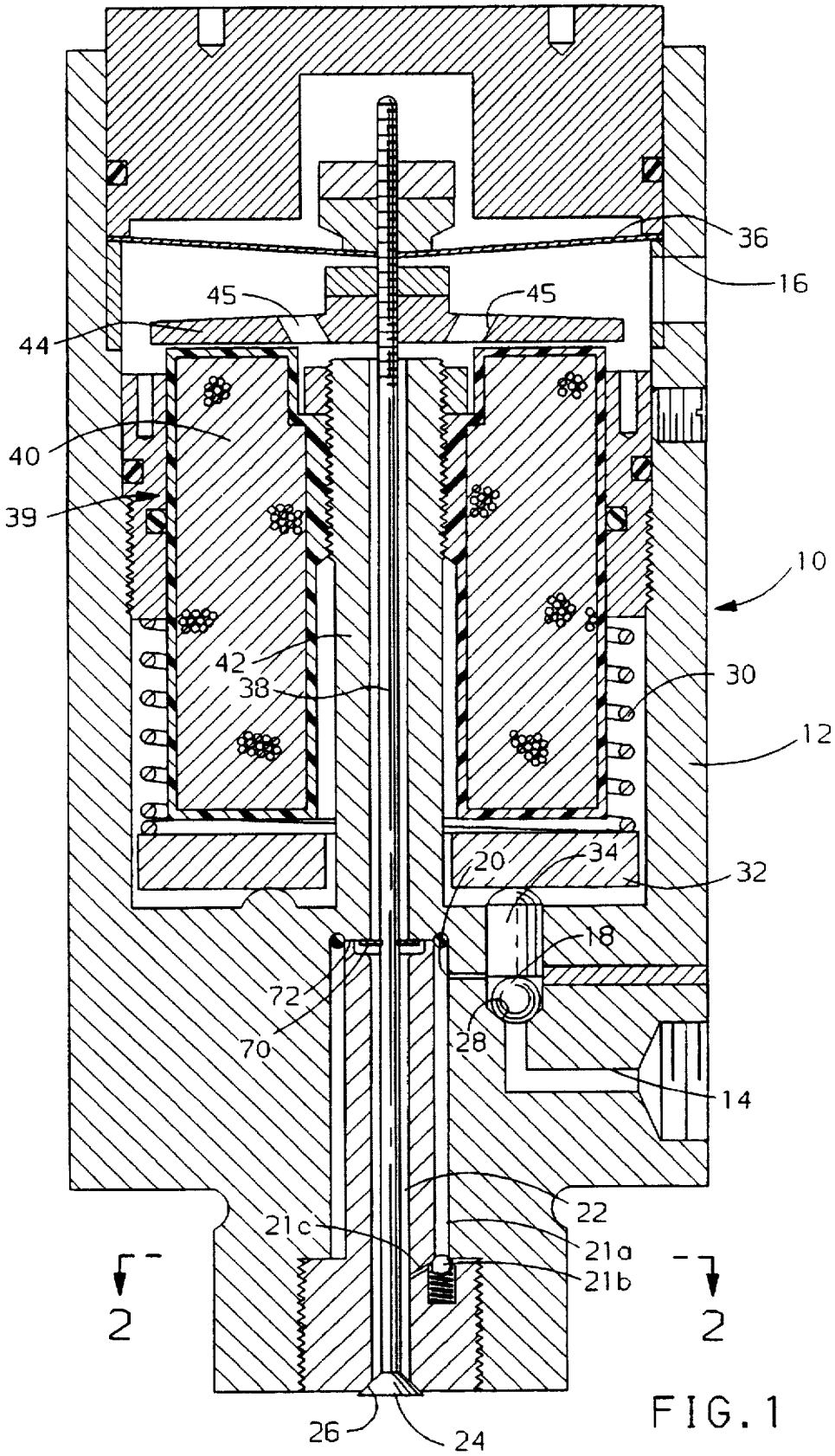
FIG. 1 is a schematic axial sectional view of one injector employing this invention.
Figure 2:
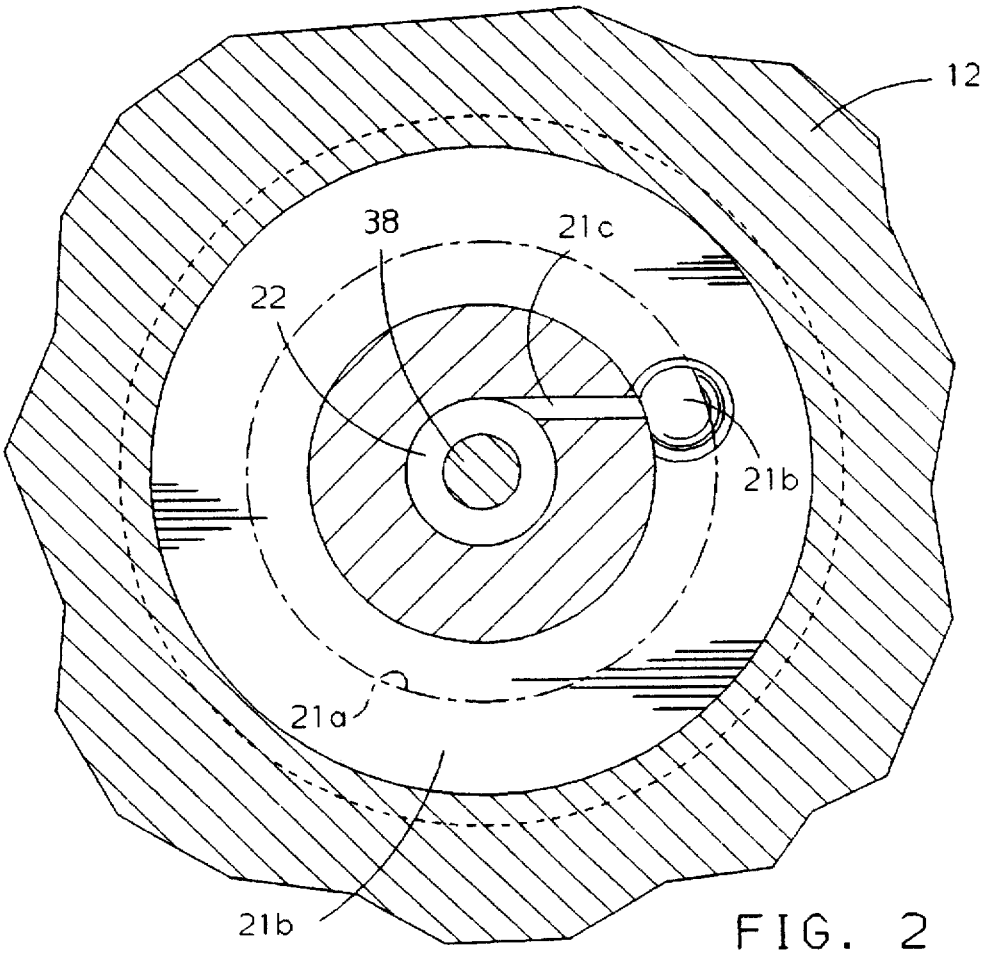
FIG. 2 is a transverse sectional view of a portion of the FIG. 1 injector taken along line 2—2 of FIG. 1 and enlarged to show tangential introduction of the metered fuel.
Figure 3:
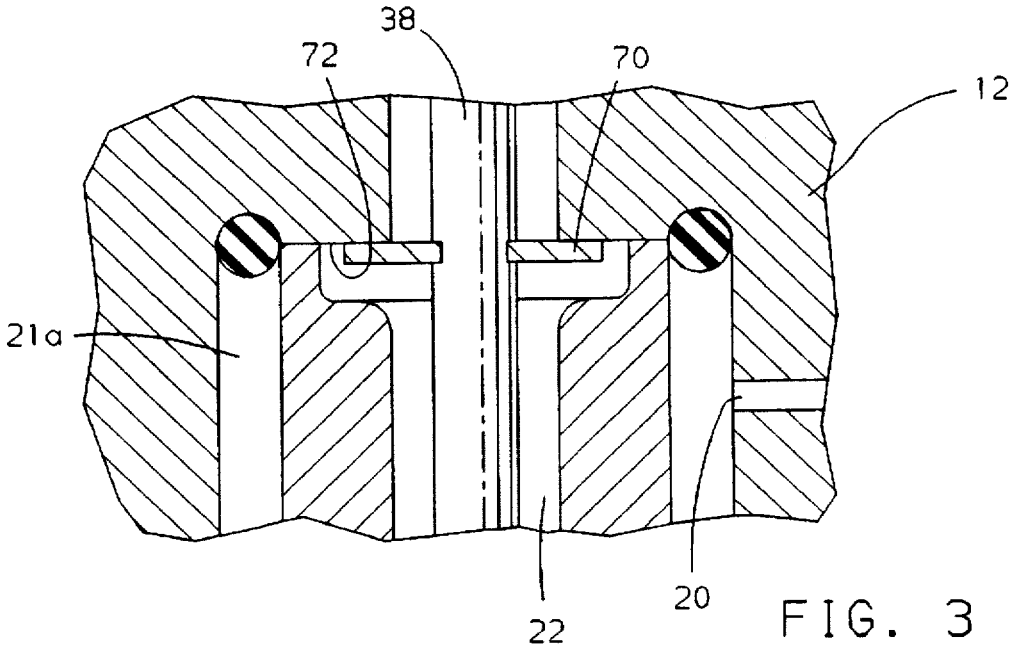
FIG. 3 is a view of a portion of the FIG. 1 injector enlarged to show a check valve.

Referring first to FIGS. 1–3, an injector 10 has a body 12 that receives fuel through an inlet 14 and air through an inlet 16. A ball-type fuel metering valve 18 controls inlet 14; when ball valve 18 is opened, fuel is metered through an orifice 20 into an annular chamber 21*a*; the metered fuel then displaces a spring-biased ball check valve 21*b* and is delivered through a nozzle passage 21*c* to a central passage 22 extending axially through body 12. A poppet-type charge delivery valve 24 engages a valve seat 26 surrounding the lower end of passage 22; when opened, valve 24 delivers a charge of fuel and air directly into an engine combustion chamber.

Ball valve 18 is biased against a seat 28 in inlet 14 by a coil spring 30 acting through a disc 32 and a pushrod 34.

Poppet valve 24 is biased against seat 26 by a diaphragm-type spring 36 acting on the stem 38 of poppet valve 24.

Disc 32 is a permanent magnet armature of a solenoid assembly 39 having a coil 40 threaded onto a center post 42 in body 12. When coil 40 is energized with a positive current, coil 40 attracts disc armature 32 against the bias of spring 30, the fuel pressure in inlet 14 lifts ball valve 18 and pushrod 34, and fuel flows around ball 18 and is metered through orifice 20, chamber 21*a* and directional passage 21*c* to central passage 22. When the desired amount of fuel has been metered into passage 22, coil 40 is de-energized, and spring 30 re-engages fuel metering valve 18 with its seat 28.

Another permanent magnet armature 44 is secured on valve stem 38. Armature 44 has apertures 45 that allow air flow from inlet 16 to passage 22. When coil 40 is energized with a negative current, coil 40 attracts armature 44 against the bias of spring 36, poppet valve 24 is displaced from seat 26, and the fuel-air charge in passage 22 is delivered into the engine. When the charge has been delivered into the engine, coil 40 is de-energized, and spring 36 re-engages charge delivery valve 24 with its seat 26.

When coil 40 is energized with a positive current to attract armature 32 and meter fuel into passage 22, armature 44 is repelled and adds to the valve closing force of spring 36 to maintain charge delivery valve 24 engaged with seat 26. When coil 40 is energized with a negative current to attract armature 44 and deliver the fuel-air charge from passage 22, armature 32 is repelled and adds to the valve closing force of spring 30 to maintain fuel metering valve 18 engaged with seat 28.

As shown in FIG. 1, nozzle passage 21*c* is angled downwardly toward the lower or discharge end of central passage 22, and as shown in FIG. 2, nozzle passage 21*c* directs the metered fuel tangentially into central passage 22. The metered fuel is thereby concentrated immediately adjacent charge delivery valve 24 to assure that, when charge delivery valve 24 is opened, it is delivered into the combustion chamber and not retained in central passage 22.

A valve disc 70 is secured to valve stem 38 and sealingly engages a shoulder 72 in central passage 22. Disc 70 prevents the fuel in the lower portion of central passage 22 from migrating back toward air inlet 16. Disc 70 disengages from shoulder 72 to allow air flow through central passage 22 when coil 40 attracts armature 44 to open poppet valve 24.

We believe the volume of central passage 22 below disc 70 should be limited to between ten and twenty times the maximum volume of fuel metered into central passage 22 during a metering event. Such a volume is small enough to be purged of fuel during each injection event, yet not so small as to cause a significant pressure increase during a metering event.

It is noted that ball check valve 21*b* will protect fuel metering orifice 20 and fuel metering valve 18 from any combustion products that enter central passage 22 while poppet valve 24 is open.

Moreover, the substantial volume of fuel in annular chamber 21*a* surrounding central passage 22 may absorb sufficient heat that the hot combustion products will not cause formation of deposits in central passage 22.

Other details of injector 10 are described in Ser. No. 07/841,909 and that disclosure is incorporated by reference.

Figure 4:
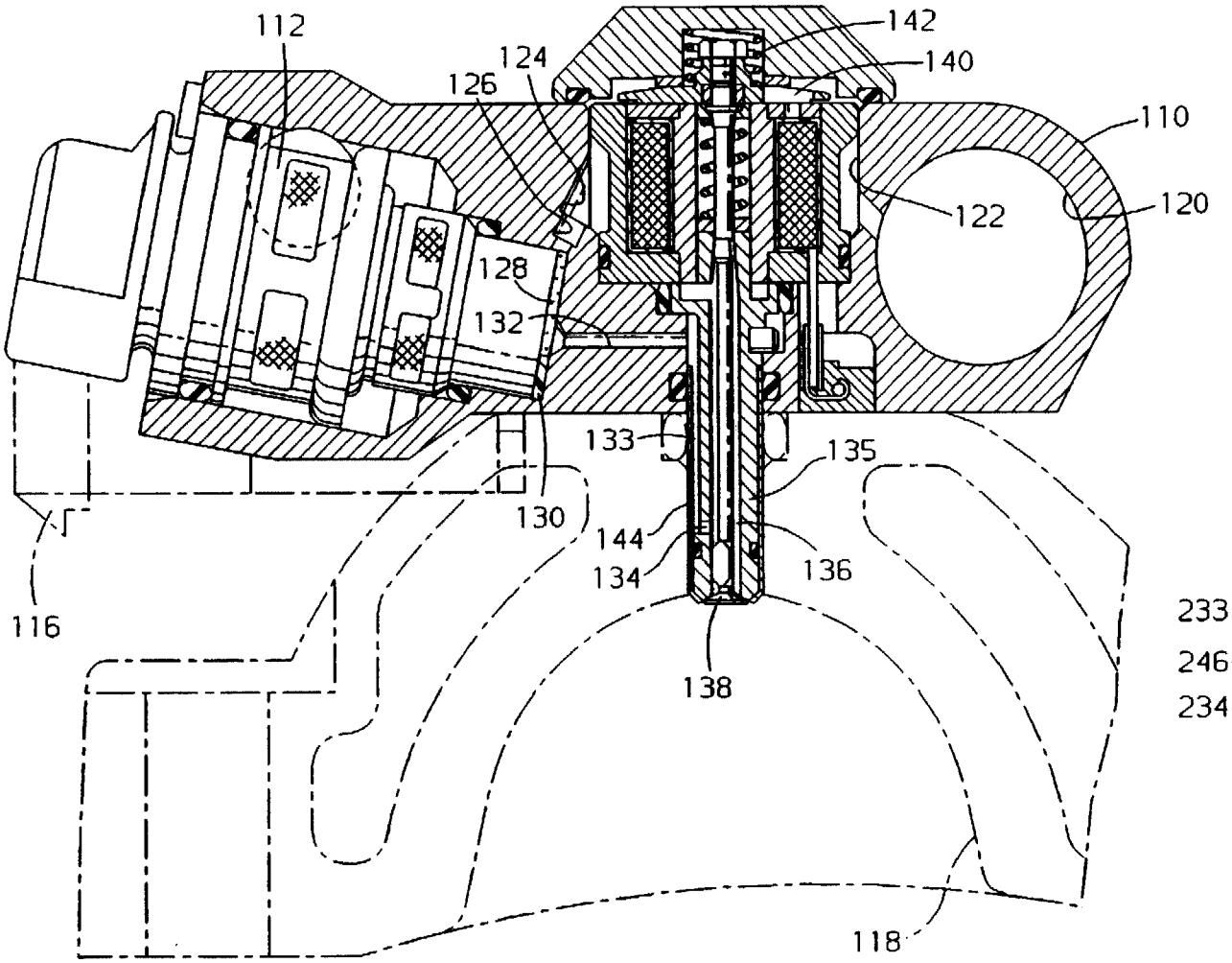
FIG. 4 is an axial sectional view of another injector employing this invention, shown installed in the cylinder head of an engine.

Referring next to FIG. 4, a rail assembly has a body 110 that supports a fuel metering injector 112 and a charge delivery injector 114 and associated electrical wiring and connectors 116 on an engine so injector 114 may deliver a charge of fuel and air to a combustion chamber 118.

Rail body 110 has a passage 120 that supplies air to a peripheral air supply passage or channel 122 surrounding a solenoid coil in charge delivery injector 114. Channel 122 supplies air to a drilled air supply passage 124 containing a cup restrictor 126 that provides a calibrated orifice in passage 124. Passage 124 supplies air to an air space 128 between the end of fuel metering injector 112 and body 110; air space 128 is a wedge-shaped volume that is not occupied by a generally C-shaped elastomeric gasket 130 sandwiched between the end of fuel metering injector 112 and body 110. A drilled passage 132 connects air space 128 to a channel 133 leading to an aperture 134 in the nozzle 135 of charge delivery injector 114. Aperture 134 opens into a region 136 surrounding the stem of a valve 138.

Injector 112 delivers metered fuel through air space 128, passage 132 and channel 133 to the aperture 134 of charge delivery injector 114, and through aperture 134 into the region 136 of injector 114. When the solenoid coil of charge delivery injector 114 is energized, its armature 140 is attracted against the bias of a return spring 142 to open valve 138. Air flow from passage 120 through channel 122, passage 124, air space 128, passage 132, channel 133, aperture 134 and region 136 then delivers the fuel into combustion chamber 118.

Nozzle 135 has a sleeve 144 closing channel 133.

Nozzle aperture 134 is located close to the lower or discharge end of central region 136. The metered fuel is thereby concentrated immediately adjacent charge delivery valve 138 to assure that, when charge delivery valve 138 is opened, it is delivered into combustion chamber 118 and not retained in central region 136.

Figure 5:
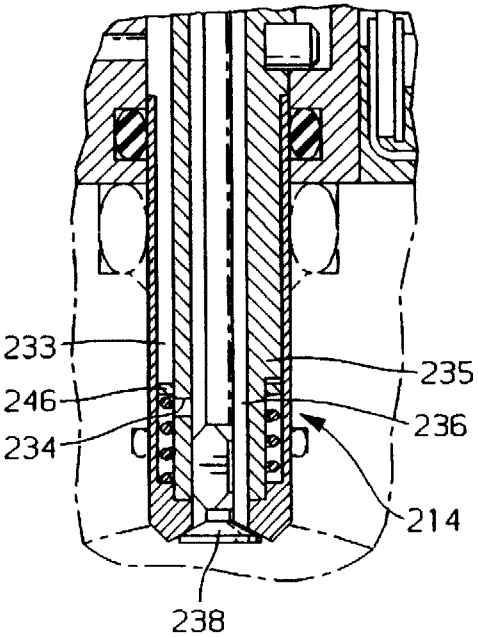
FIG. 5 shows a modification of the FIG. 4 injector.

The charge delivery injector 214 shown in FIG. 5 is similar to injector 114, but also includes an annular, spring-biased check valve 246 surrounding the nozzle 235 at the lower end of the channel 233. When the fuel metering injector delivers metered fuel into channel 233, the fuel displaces check valve 246 and is delivered through the aperture 234 to the central region 236 surrounding the stem of the valve 238.

Other details of charge delivery injectors 114 and 214 are described in U.S. Pat. No. 5,036,824; the disclosure of that patent is incorporated by reference.

Certain details of the structure at the top of charge delivery injectors 114 and 214 are set forth in U.S. Pat. No. 4,978,074 issued 18 Dec. 1990 in the name of L. H. Weinand; the disclosure of that patent is incorporated by reference.

The embodiments of the invention in which an exclusive property or privilege is claimed are defined as follows:

1. An injector for delivering a charge of fuel and air to an engine, said injector including a body having a central passage extending to a valve seat, a poppet valve secured on a valve stem extending through the central passage and engageable with the valve seat to control flow therethrough, an air inlet opening into the central passage, a fuel nozzle opening into the central passage near the valve seat, a valve periodically metering fuel through the nozzle into the central passage to create a fuel-air charge in the central passage, and an actuator periodically disengaging the poppet valve from the valve seat to deliver the fuel-air charge from the central passage, wherein the valve stem includes a valve disc that sealingly engages the central passage, and wherein the volume of the central passage between the valve seat and the valve disc is in the range of about ten to about twenty times the maximum volume of the fuel delivered through the nozzle during a fuel metering event.

2. An injector for delivering a charge of fuel and air to an engine, said injector including a body having a central passage extending from an air inlet to a valve seat, a poppet valve secured on a valve stem extending through the central passage and engageable with the valve seat to control flow therethrough, a valve disc secured on the valve stem and engageable with a portion of the central passage to permit flow from the air inlet to the valve seat but prevent flow from the valve seat to the air inlet, a fuel nozzle opening into the central passage near the valve seat, a valve periodically metering fuel through the nozzle into the central passage to create a fuel-air charge in the central passage, and an actuator periodically disengaging the poppet valve from the valve seat to deliver the fuel-air charge from the central passage, and wherein the volume of the central passage between the valve seat and the valve disc is in the range of about ten to about twenty times the maximum volume of the fuel delivered through the nozzle during a fuel metering event.

* * * * *